US008584982B2

(12) United States Patent
Eakin

(10) Patent No.: US 8,584,982 B2
(45) Date of Patent: Nov. 19, 2013

(54) APPARATUS FOR COVERING ROLLED PAPER PRODUCTS AND DISPENSING FRAGRANCE

(76) Inventor: Doyle W. Eakin, Oakhurst, CA (US)

( * ) Notice: Subject to any disclaimer, the term of this patent is extended or adjusted under 35 U.S.C. 154(b) by 589 days.

(21) Appl. No.: 12/766,830

(22) Filed: Apr. 23, 2010

(65) Prior Publication Data

US 2010/0270415 A1 Oct. 28, 2010

Related U.S. Application Data

(60) Provisional application No. 61/172,144, filed on Apr. 23, 2009.

(51) Int. Cl.
*B65H 16/06* (2006.01)

(52) U.S. Cl.
USPC ..... 242/598.5; 242/596.8; 242/422.5

(58) Field of Classification Search
USPC ..... 242/596.8, 598, 598.1, 598.3, 598.5, 242/598.6, 422.4, 422.5, 905; 239/52; 312/34.22–34.24, 34.1, 34.8, 34.19, 312/34.21
See application file for complete search history.

(56) References Cited

U.S. PATENT DOCUMENTS 1,414,443 A * 5/1922 Steiner ..... 242/565
2,650,773 A * 9/1953 Fanning ..... 242/422.5
2,739,840 A * 3/1956 Anderson ..... 242/422.5

* cited by examiner

*Primary Examiner* — Sang Kim
*Assistant Examiner* — Juan Campos, Jr.
(74) *Attorney, Agent, or Firm* — Richard A. Ryan

(57) ABSTRACT

An apparatus for covering a rolled paper product, such as toilet paper or paper towels, to reduce the visibility of the paper roll. The apparatus comprises a base member that attaches to a surface, a guide post slidably engaged with the base member to move up and down relative thereto, a top member attached to or integral with the guide post and extending over the paper roll, a roller holder attached to or integral with the top member or guide post and a roller rotatably supported by the roller holder in rotatable engagement with the paper roll to rotate therewith. As paper is removed from the roll, the roller rotates and moves the guide post down to maintain the desired spacing between the top member and the paper roll. Preferably, fragrance material in the roller dispenses fragrance when the roller rotates in response to rotation of the paper roll.

20 Claims, 6 Drawing Sheets

APPARATUS FOR COVERING ROLLED PAPER PRODUCTS AND DISPENSING FRAGRANCE

CROSS-REFERENCE TO RELATED APPLICATIONS

This patent application claims priority to U.S. Provisional Patent Application No. 61/172,144 filed Apr. 23, 2009.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The present invention relates generally to apparatuses configured to cover a roll of paper products during the dispensing of paper from the roll. More particularly, the present invention relates to such apparatuses that are configured to maintain the cover in spaced apart relation over the paper roll as paper is dispensed. Even more particularly, the present invention relates to such cover apparatuses that are also configured to automatically dispense a fragrance upon removal of paper from the roll of paper.

B. Background

Paper products are commonly provided in a rolled form configured for the user of the product to remove a portion of the paper product from the roll as needed for his or her use. Examples of such paper products are toilet paper, paper towels and the like (such products are collectively referenced herein as "rolled paper products"). Generally, the paper portion of the rolled paper product is rolled around a tubular center member having an open center area. To simplify removal of paper from the roll, many people utilize rolled product holders that are configured to cooperate with the tubular center member such that the rolled paper product is placed on the holder by inserting an axle portion of the holder through the open area of the tubular center member. In this manner, the rolled paper product is able to rotate or roll around the axle portion of the holder. Often these rolled paper products are provided with paper having perforations at substantially uniform places along the roll of paper to simplify tearing off one or more sections of the paper product. When a portion of the product is desired for use, which may be one or more sections, the user will pull on the outward extending end of the product that extends from the roll of paper and then tear off the desired length or number of sheets of paper.

Typically, the rolled product holder that rotatably holds the rolled paper product is mounted to a substantially vertical surface, such as an interior wall, the side or front wall of a cabinet or like surfaces, with the rolled paper product extending outward from the surface. While the availability of the rolled paper product is necessary, particularly in the bathroom, the outwardly extending rolled paper product is not very attractive. In fact, most people generally consider a roll of toilet paper to be unsightly and to be a visual distraction from a bathroom that may otherwise be decorated to provide a more pleasant atmosphere. While generally not considered as unsightly, an outwardly extending roll of paper towels does distract from an otherwise decorated kitchen. As such, some people use a cover apparatus to cover the rolled paper product. Some of these apparatuses substantially enclose the rolled paper product and product holder. Although such cover apparatuses improve the visual appearance of the room in which it is used, they can make it somewhat difficult to access the rolled paper product when use of the product is desired and/or when it is necessary to replace the rolled paper product. Other cover apparatuses have a cover that is fixedly attached to the wall, cabinet or other surface on which the product holder is mounted, which will result in the cover becoming less effective at covering the rolled paper product as paper is removed therefrom. As a result of the limitations of presently available cover apparatuses, most rolled paper products are left uncovered.

As set forth above, rolled paper products are commonly utilized in bathrooms and kitchens. These rooms are generally known to have unpleasant smells that are desired to be masked or eliminated by a fragrance. In fact, at the time a person is removing a quantity of paper from the rolled paper product, he or she often correspondingly desires a quantity of fragrance be dispensed into the air to mask and/or eliminate odors. With regard to the bathroom, unpleasant odors often emanate from a toilet bowl as a result of use of the toilet by people for the evacuation of human waste. The odor that emanates from the toilet bowl, or use thereof, can and often fills the room (i.e., the bathroom) where the toilet is utilized. In both private and public bathroom facilities, the use of the toilet by a number of individuals can result in an unpleasant facility. With regard to the kitchen, odors commonly emanate from the preparation and cooking of food. Although many of these odors are not necessarily unpleasant, the odor from a combination of various food items can be unpleasant. In addition, many of these odors tend to stay around long after the food has been prepared, served and consumed. The waste generated from the food production and from that which was not eaten will add to the odors. Many people also keep a trash receptacle in the kitchen area to receive the waste, which can also be a source of unpleasant odors. Most people desire to eliminate or at least generally mask these odors.

As a result of the desire to control odor, many people utilize one or more apparatuses for dispensing fragrance into the air to mask or eliminate odors. Although such dispensing apparatuses may be located throughout the house, they are most often located in the bathroom, kitchen and/or other rooms where odors are more likely to be generated and present. One method of addressing odors is to utilize dried flowers, candles or other items that emit a pleasant odor to cover-up and/or eliminate unpleasant odors in the bathroom and/or kitchen. Most people, however, also take a more proactive approach to covering-up or eliminating any unpleasant odors. One such method is the use of canned air fresheners. The typical canned air freshener is of the aerosol type that has a push-type dispensing mechanism at the top of the can the user pushes to emit a spray of fragrance whenever he or she desires to eliminate or mask any odors. People also utilize fragrance dispensers that contain a liquid-based fragrance solution which is sprayed into the air to address unpleasant odors. One problem with any of the spray-type air fresheners is that the user must take affirmative action to cause the container to emit the fragrance. If he or she forgets to activate the spray, then the unpleasant odors remain.

Another type of air freshener system utilized in bathrooms, kitchens or other rooms is one which automatically emits the fragrance. Some of these are plugged into and remain at an electric outlet such that heat generated by the device emits the desired fragrance. Others are plugged into the outlet with an electrical cord and utilize a pump mechanism to dispense the fragrance. Yet others have a battery-operated system to emit the fragrance. One problem with many of these devices is that they continuously emit the fragrance, whether it is needed or not, thereby wasting both the fragrance material and electricity. Some devices attempt to reduce the usage of the fragrance by periodically emitting the fragrance. Even these devices tend to waste fragrance by activating when it is not needed or they fail to solve the odor problem by not emitting fragrance when it is needed. Some devices attempt to solve the waste and failure to act problem by having a manually operated mechanism. As with spray cans or bottles, however, these apparatuses depend on the user to activate the fragrance.

What is needed, is an improved apparatus for covering rolled paper products and for dispensing fragrance in rooms where odors tend to be created and/or exist. The preferred cover apparatus should substantially cover the rolled paper product so as to eliminate the unsightliness thereof without interfering with use or replacement of the rolled paper product. The preferred cover apparatus should be configured to continue to substantially cover the rolled paper product as the size of the roll reduces in diameter due to paper being removed from the roll. Preferably, the cover apparatus should also be configured with a fragrance dispenser that automatically dispenses a fragrance into the room where the rolled paper product is utilized. The preferred fragrance dispenser should be of the type that does not rely on the user of the rolled paper product to activate a mechanism to dispense the fragrance and should not rely on electricity or other power means to dispense the fragrance. Preferably, the dispenser apparatus should allow the user to easily fill and refill the fragrance associated with the apparatus as needed or desired.

SUMMARY OF THE INVENTION

The apparatus for covering rolled paper products and dispensing fragrance of the present invention provides the benefits and solves the problems identified above. That is to say, the present invention discloses an apparatus for substantially covering a rolled paper product to reduce the unsightliness normally associated with rolled paper products. In a preferred embodiment, the present cover apparatus can be utilized as a decorative item in a bathroom, kitchen or other area where rolled paper products are utilized. The preferred cover apparatus of the present invention covers the rolled paper product without interfering with use or replacement of the product and maintains the cover in position over the rolled paper product as the size of the roll reduces in diameter due to paper being removed from the roll. In the preferred embodiment, the cover apparatus also includes a fragrance dispenser that cooperatively engages the roll of paper to automatically dispense a quantity of fragrance when the user removes paper from the roll. The cover apparatus with fragrance dispenser of the present invention is particularly suitable for use with toilet paper in a bathroom, paper towels in a kitchen and similar uses of rolled paper products. The preferred fragrance dispenser contains a quantity of fragrance that is easily refilled or replaced by the user as needed.

In the primary embodiment of the present invention, the cover apparatus is configured to substantially cover a rolled paper product having a roll of paper that is rotatably mounted on a product holder attached to a surface, such as a wall, cabinet or the like. The preferred cover apparatus generally comprises a base member that attaches to the surface, a guide post slidably engaged with the base member to move up and down relative thereto, a top member having a proximal end that is attached to or integral with the guide post and a distal end that extends outwardly from the guide post and generally over the rolled paper product, a roller holder that is attached to or integral with at least one of the top member and the guide post to move the guide post up and down with the roller holder and a roller that is in rotatable engagement with the rolled paper product to rotate the roller when a user rotates the roll of paper and to maintain the top member and the roll of paper in fixed spaced apart relation selected so as to substantially hide the roll of paper. The guide post and the top member move downward with the roller when the user removes paper from the roll of paper so as to substantially maintain the top member and the roll of paper in the desired fixed spaced apart relation that substantially hides the roll of paper from sight so as to reduce the visibility of the paper roll and improve the decor of a room. In the preferred embodiment, the cover apparatus has a fragrance material that is associated with the roller so as to activate the fragrance material and dispense fragrance when the roller rotates in response to rotation of the roll of paper. In a preferred configuration, the fragrance material is disposed inside the roller. In the preferred embodiment, the top member comprises a front section at the distal end of the top member and a rear section at the proximal end of the top member, with the front section pivotally attached to the rear section to allow the top section to move between a lowered position during use and a raised position for access to the paper roll and to refill or replace any fragrance material. In the preferred embodiment, a brace member interconnects the roller holder and the guide post to support the roller holder separately from the front section of the top member. Preferably, the brace member is attached to or integral with the rear section of the top member. To better hide the roll of paper, the top member has a front area that is curved generally downward in front of the roll of paper. In an alternative embodiment, the base member has a pair of spaced apart side sections that each have a slot therein that slidably receives one or more pins on the sides of the guide post.

Accordingly, the primary objective of the present invention is to provide an improved cover apparatus for covering rolled paper products that has the benefits described above and solves the various problems associated with presently available apparatuses for covering rolled paper products.

More specifically, it is a primary objective of the present invention to provide a cover apparatus for rolled paper products that substantially covers the rolled paper product to reduce the unsightliness thereof without interfering with the normal use and replacement of the rolled paper product.

It is also an important objective of the present invention to provide a cover apparatus for rolled paper products that maintains the cover portion thereof in a generally fixed spaced apart relation with the rolled paper product as the roll of paper reduces in diameter due to removal of paper from the roll.

It is also an important objective of the present invention to provide a cover apparatus for rolled paper products that includes a fragrance dispensing mechanism which cooperatively engages the rolled paper product such that when the user removes a quantity of paper from the paper roll the apparatus will automatically dispense a quantity of fragrance into the air.

It is also an important objective of the present invention to provide a cover apparatus for rolled paper products having a fragrance dispensing mechanism configured to allow the user to refill the fragrance dispenser as needed or desired.

It is also an important objective of the present invention to provide a cover apparatus for rolled paper products that can be utilized as a decorative item in a bathroom, kitchen or other area where rolled paper products are utilized.

The above and other aspects and advantages of the present invention are explained in greater detail by reference to the attached figures and the description of the preferred embodiment which follows. As set forth herein, the present invention resides in the novel features of form, construction, mode of operation and combination of the above presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures and drawings are merely illustrative of one or more of the preferred embodiments and, as such, represent one or more ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein are directed to certain rolled paper products and configurations of product holders, those skilled in the art will readily appreciate and understand that this is set forth merely for purposes of simplifying the present disclosure and that the present invention is not so limited.

Figure 1:
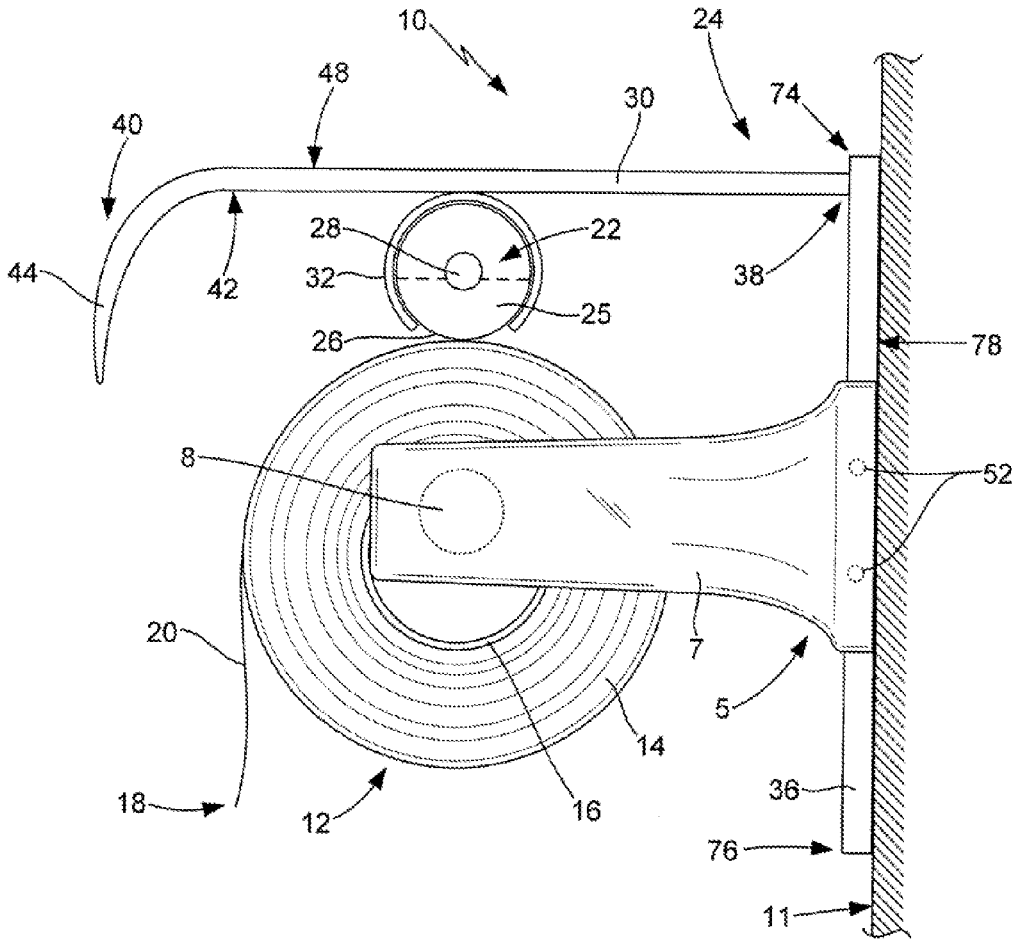
FIG. 1 is a side view of a cover apparatus configured according to a preferred embodiment of the present invention having a fragrance dispensing mechanism associated therewith and shown mounted on a surface and in use with a rolled paper product.
Figure 5:
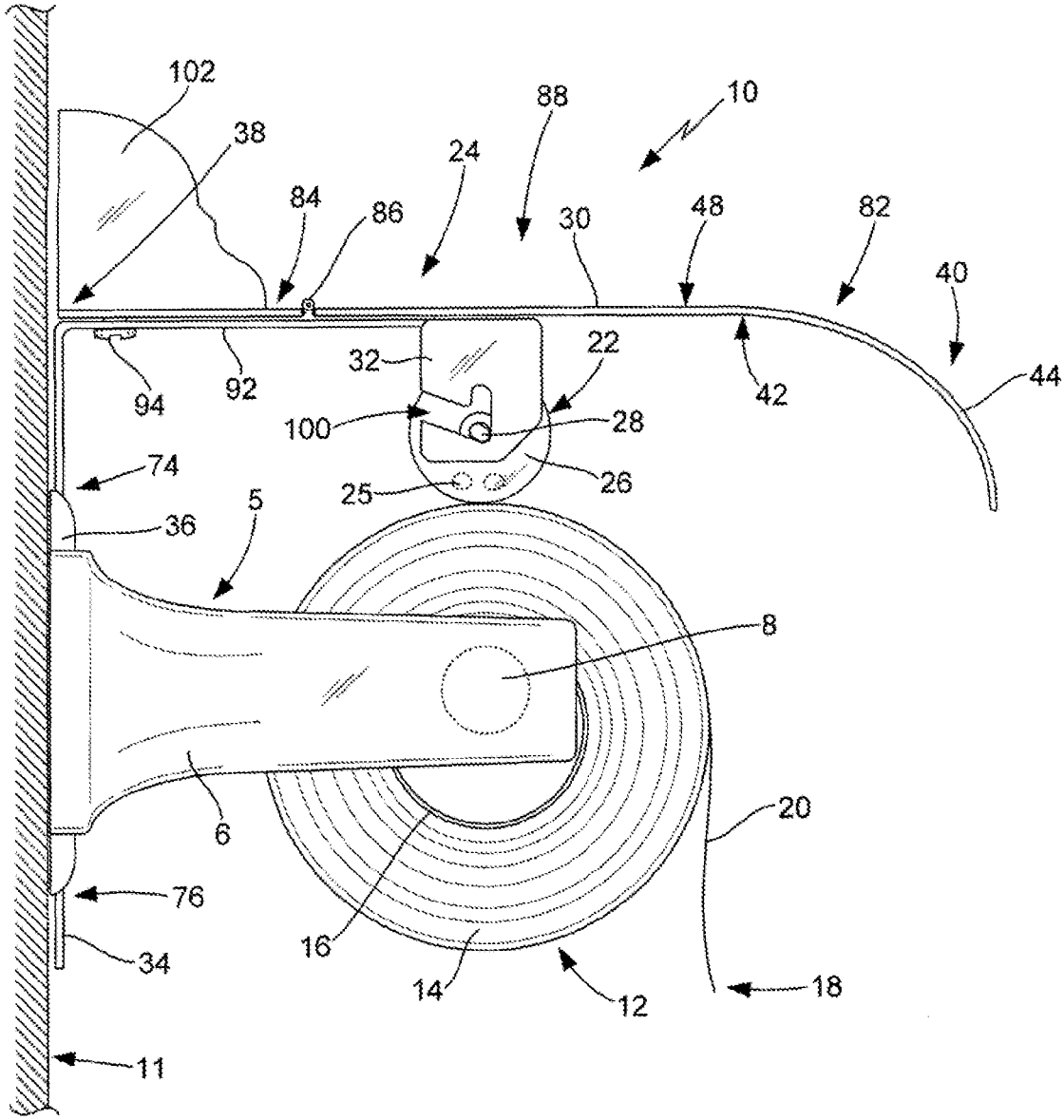
FIG. 5 is a side view of a cover apparatus configured according to the preferred embodiment of the present invention having a fragrance dispensing mechanism associated therewith and shown mounted on a surface and in use with a rolled paper product.
Figure 6:
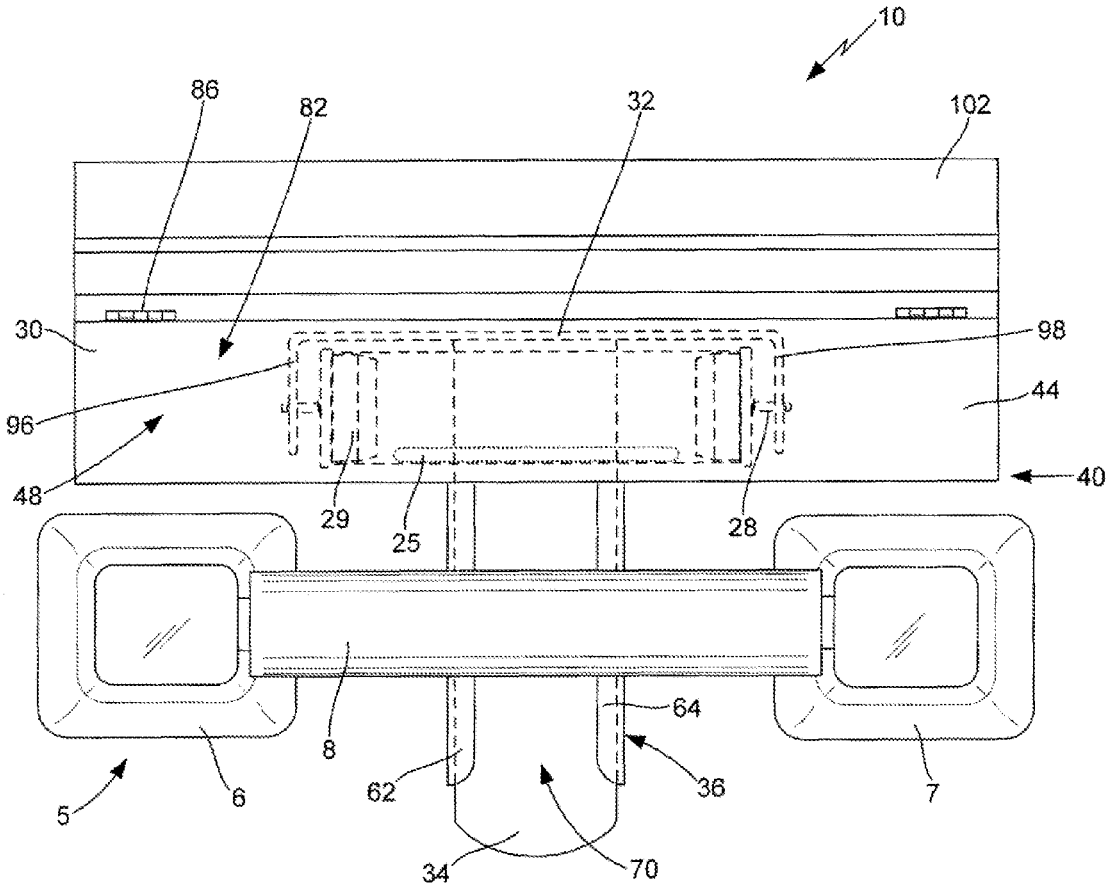
FIG. 6 is a front view of the cover apparatus of FIG. 5 shown with the rolled paper product removed.
Figure 10:
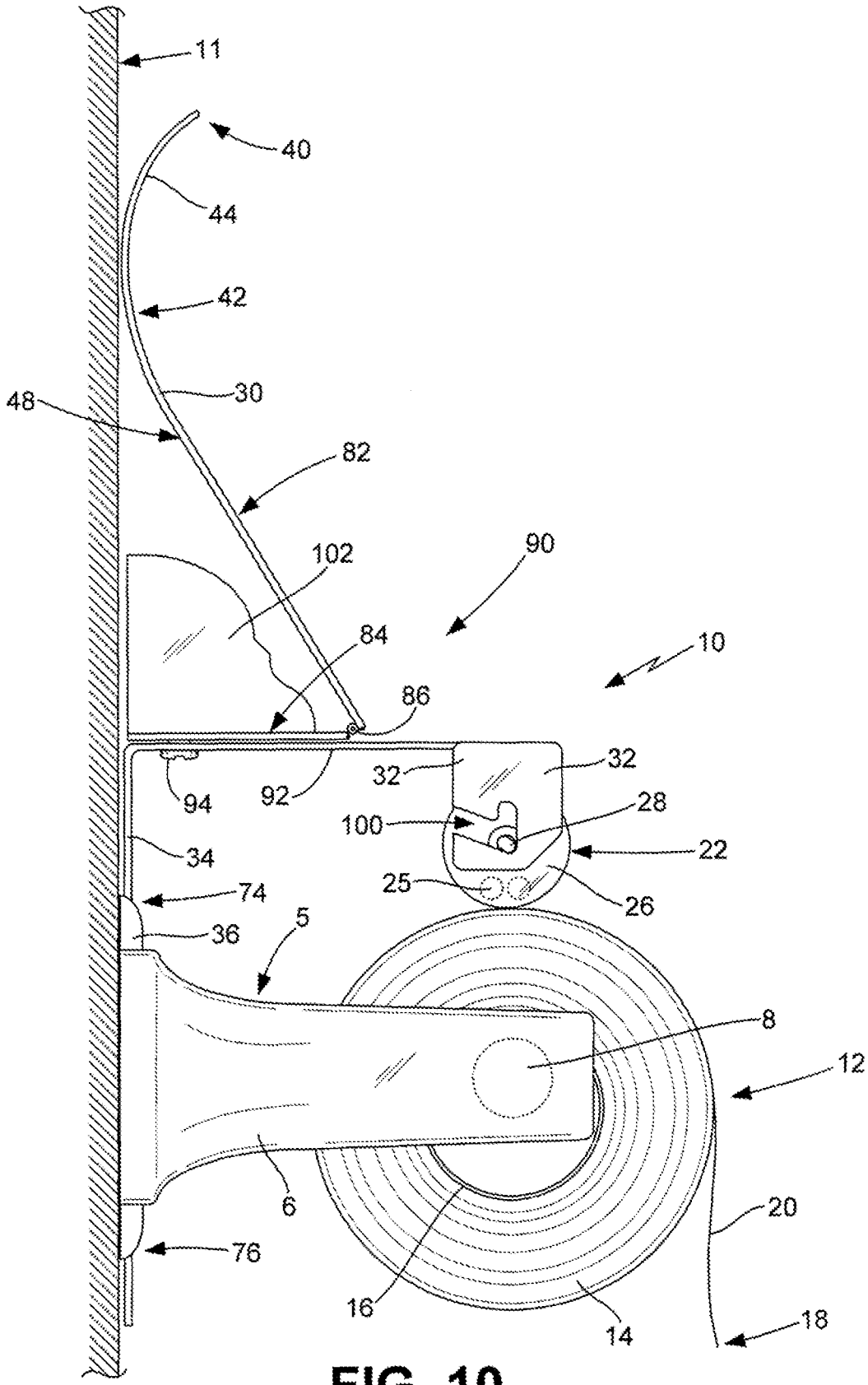
FIG. 10 is a side view of the cover apparatus of FIG. 5 shown with the top member tilted backward for ease of replacing the rolled paper product and/or the fragrance.

A cover apparatus that is configured pursuant to the preferred embodiments of the present invention is identified generally as 10 in FIGS. 1, 5, 6 and 10. As shown in FIGS. 1, 5 and 10, the cover apparatus 10 of the present invention is typically mounted to a substantially vertical, generally planar surface 11, such as a wall or cabinet in a bathroom or kitchen, and is utilized with a rolled paper product 12. As will be readily appreciated by those skilled in the art, the surface 11 to which the cover apparatus 10 is mounted may be a vertical, planar portion of a larger non-vertical and/or non-planar wall or cabinet and be in an area other than a bathroom or kitchen. The typical rolled paper product 12 comprises a roll of paper 14 disposed about a center tubular member 16 with the leading edge 18 of the paper 20 extending generally outward and downward from the roll of paper 14, as best shown in FIGS. 1, 5 and 10. As well known in the art, rolled paper products 12 are usually rotatably mounted on a rolled product holder 5 that is mounted to surface 11. As shown in FIG. 6, the typical paper holder 5 has one or more arms, such as arms 6 and 7, that extend outward from the surface 11 to horizontally support a holder axle 8 that is received through the center of tubular member 16 to rotatably support the rolled paper product 12.

In the preferred embodiment, the cover apparatus 10 comprises a fragrance dispensing mechanism 22 that is operatively supported by a support structure 24 against the roll of paper 14 such that the rolling movement of the roll of paper 14 when the user pulls on the product 12, typically at or near the leading edge 18, to remove paper 20 therefrom, the fragrance dispensing mechanism 22 dispenses a fragrance into the air around the cover apparatus 10. In a preferred embodiment, fragrance mechanism 22 has a fragrance material, shown generally as 25 in FIGS. 1 and 5, disposed inside a roller 26 such that the rolling movement of roller 26 will activate the fragrance material 25, thereby dispensing fragrance from fragrance mechanism 22 into the air generally around cover apparatus 10. In one embodiment, shown in FIG. 1, the fragrance material 25 is a liquid that splashes on a sponge or like absorbing member to cause fragrance to be dispensed in the air around cover apparatus 10. In the preferred embodiment, shown in FIGS. 5 and 10, fragrance material 25 is one or more sticks or stick-like fragrance objects that dispense their fragrance upon rolling movement of roller 26. Alternatively, fragrance material 25 can be of the type of material that is commonly utilized in vehicles and configured to hang from the rear view mirror or other structure inside the vehicle (e.g., typically in the shape of a tree or other object). Various other types of fragrance material 25 will also be suitable for the fragrance mechanism 22. Preferably, roller 26 is rotatably supported by support structure 24 and rotates around axle member 28. In the preferred embodiment, the roller 26 of fragrance mechanism 22 will be of the type that allows the user to fill roller 26 with his or her desired fragrance and to refill roller 26 when it is empty or near empty or when a different fragrance is desired by the user or others. The roller 26 can have a removable cap or end piece 29 (shown in FIG. 6) that allows the user to fill the interior of the roller 26 with the desired fragrance material 25.

As shown in FIGS. 1, 5 and 10, the support structure 24 is configured to attach to a wall, side of a cabinet or other surface 11 generally above the paper product 12 with the fragrance mechanism 22 in rolling engagement with the roll of paper 14. In one embodiment, the support structure 24 generally comprises a top member 30, a roller holder 32 that rotatably holds the roller 26 of the fragrance mechanism 22, a guide post 34 attached to top member 30 and a base member 36 that attaches to the wall or cabinet and slidably receives the guide post 34. As stated above and set forth in more detail below, these components cooperate in a manner that allows the fragrance mechanism 22 to move downward as the diameter of the roll of paper 14 is decreased due to paper 20 being removed from the roll of paper 14, typically by pulling at or near leading edge 18 thereof.

Figure 2:
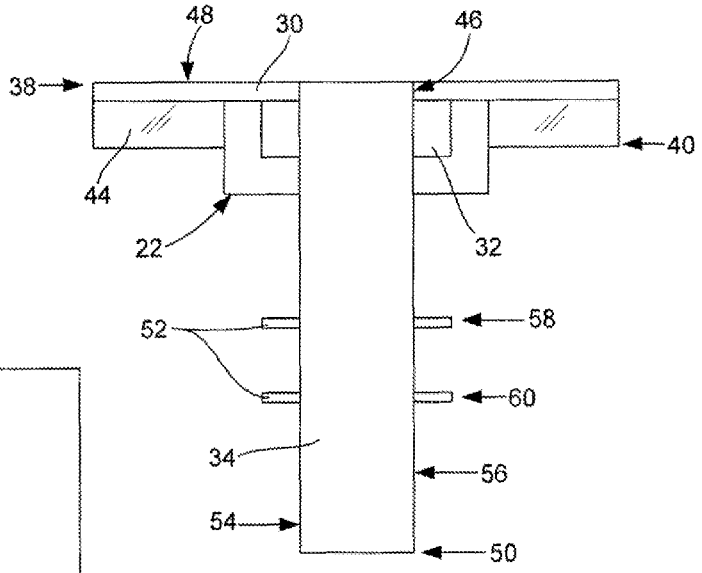
FIG. 2 is a back view of the top cover, guide post and fragrance dispensing mechanism of the cover apparatus of FIG. 1.

With regard to the embodiment of FIG. 1, the top member 30 has a first or proximal end 38 that is fixedly attached to the guide post 34 and a second or distal end 40 that extends outwardly therefrom and is disposed over the rolled paper product 12 when cover apparatus 10 is in use. The proximal end 38 of top member 30 is disposed generally proximally to base member 36 when guide post 34 is received in the base member 36. In this embodiment, the roller holder 32 is attached to or integral with the bottom surface 42 of the top member 30, as best shown in FIG. 1. As also best shown in FIG. 1, the top member 30 has a curved front area 44 that extends generally downward from distal end 40 of top member 30 to block the user's view, or at least most of the view, of roller holder 32 and the fragrance mechanism 22 during use. The guide post 34 of this embodiment is attached to or integral with the proximal end 38 of top member 30 and extends generally below the bottom surface 42 thereof, as shown in FIG. 2, with the upper end 46 of guide post 34 generally even with the top surface 48 of top member 30 and the lower end 50 of guide post 34 extending below top member 30. As also shown in FIG. 2, the guide post 34 has one or more outwardly extending pins 52 extending outward from the first 54 and second 56 sides thereof. In a preferred configuration of this embodiment, the apparatus comprises an upper set 58 of guide pins 52 and a lower set 60 of guide pins 52. As set forth below, the guide pins 52 are configured to engage the base member 36 to position and stabilize the guide member 34, and therefore the top member 30, as it moves down in response to paper 20 being removed from the roll of paper 14. Compared to a single set of guide pins 52, the use of an upper 58 and lower 60 set of guide pins 52 is believed to provide additional stability for cover apparatus 10.

Figure 3:
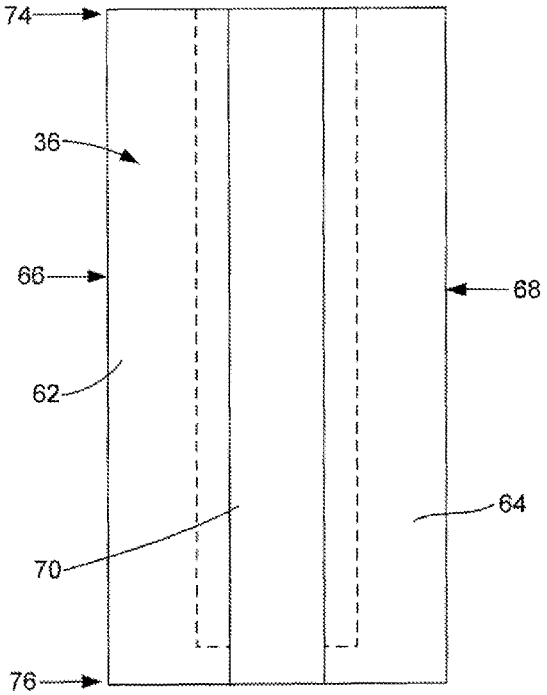
FIG. 3 is a front view of the base member of the cover apparatus of FIG. 1.
Figure 4:
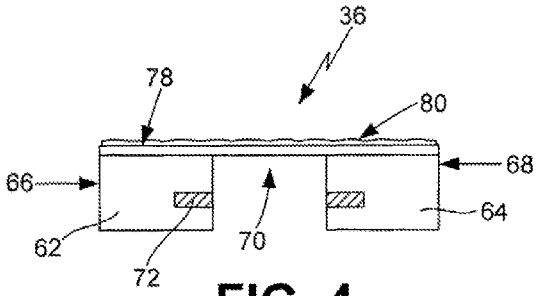
FIG. 4 is a top view of the base support of FIG. 3.

As best shown in FIGS. 3 and 4, the base member 36 comprises a first side section 62 and a second side section 64 at the first side 66 and second side 68, respectively, and a center section 70 between the first 62 and second 64 side sections. Center section 70 is sized and configured for guide member 34 to be slidably received between the first 62 and second 64 side sections during use of cover apparatus 10. For stabilization of dispensing apparatus 10, the first 62 and second 64 side sections each comprise a slot 72 sized and configured to slidably receive guide pins 52. The guide pins 52 are configured to move up and down inside the slots 72 as the top member 30 and guide member 34 move up and down. In a preferred configuration of this embodiment, best shown in FIGS. 3 and 4, the slots 72 are open at the upper end 74 of base member 36 to allow the guide member 34 and guide pins 52 to be received inside the center section 70 and slots 72 and are closed at or near the lower end 76 of base member 36 to prevent the guide member 34 (and therefore the top member 30 and fragrance mechanism 22) from falling out the lower end 76 of base member 36 when the rolled paper product 12 is removed from product holder 5. Preferably, the back wall 78 of base member 36 is generally planar so it may be placed against and attached to a wall, cabinet or other generally planar surface 11.

The top member 30, guide member 34 and base member 36 can be made out of plastic, wood, metal, composites and a variety of other materials or combination of such materials. Preferably, but not exclusively, the guide pins 52 are made out of metal or some other easy to slide yet strong and durable material so they will slide in slots 72 and not be easily broken. In use, the dispensing apparatus 10 is attached to a wall, cabinet or other surface 11 near rolled paper product 12 such that fragrance mechanism 22, filled with the desired fragrance material 25, rests on top of the roll of paper 14. In the preferred configuration of this embodiment, the roller 26 rests on top of the roll of paper 14, as shown in FIG. 1. A wide variety of attachment mechanisms, shown generally as 80, can be utilized to securely attach base member 36 to surface 11, including screws, nails, bolts, adhesives, magnets and the like. Typically, attachment mechanism 80 will be selected based on the material to which base member 36 will attach. In one embodiment, shown in FIG. 4, a pull-off adhesive strip is placed on the back wall 78 that, when the strip is pulled off, leaves an adhesive material (as attachment mechanism 80) on the back wall 78 of base member 36. When the user pulls a section of paper 20, typically by pulling at or near the leading edge 18, the roll of paper 14 will rotate, as it normally does, and cause the roller 26 of fragrance mechanism 22 to rotate. The rotation of roller 26 will cause fragrance material 25 inside roller 26 to emit fragrance from the cover apparatus 10 to help mask and/or eliminate odors in the vicinity of cover apparatus 10 and rolled paper product 12. When the fragrance material 25 of fragrance mechanism 22 is empty, the user removes the roller 26 from roller holder 32 and refills roller 26 with the fragrance material 25 of his or her choice. In an alternative embodiment, roller 26 and/or entire fragrance mechanism 22 can be configured to be replaceable with a new unit when the fragrance material is empty.

The preferred embodiment of the present invention is shown in FIGS. 5 through 10. As shown in these figures, most of the components of this embodiment are the same or substantially the same as the components of the embodiment described above and shown in FIGS. 1 through 4. In the preferred embodiment, top member 30 comprises a front section 82 and a rear section 84 that are hingedly connected by one or more hinges 86 and the roller holder 32 is not connected to the top member 30, as best shown in FIGS. 5 and 10. One benefit of having top member 30 separated into front 82 and rear 84 sections with hinge 86 is that the user will be able to raise front section 82 from its normally lowered position 88, shown in FIG. 5, to a raised position 90, shown in FIG. 10, to allow the user to access the roll of paper 14 if need be to grab onto the leading edge 18 thereof after removing some paper 20 from the roll of paper 14. Another benefit of the separated sections 82/84 is that it provides the user with easier access to the rolled paper product 12 and fragrance mechanism 22 when the user needs or desires to replace either or both of these components. As with the embodiment described above, top member 32 can be made out of a wide variety of materials and in a variety of different shapes, preferably with the curved front area 44 that extends downward to more effectively cover the rolled paper product 12 and fragrance mechanism 22. If desired, the front section 82 can be made out of a different material and/or coated with a different material than the rear section 84. In a preferred embodiment, the hinge 86 is a single piano-type hinge that extends across or substantially across the width of top member 30.

As stated above, roller holder 32 is not directly connected to the bottom surface 42 of top member 30. Instead, roller holder 32 is connected to and supported by guide post 34, as best shown in FIGS. 9 and 10. As shown in these figures, a brace member 92 supportedly interconnects roller holder 32 and guide post 34 so as to allow the front section 84 to pivot upwards, at hinge 86, without moving the roller holder 32 and, therefore, the fragrance mechanism 22 rotatably supported thereby. In the preferred embodiment, brace member 92 is elongated and the roller holder 32 is attached to or integral with the outwardly extending distal end thereof, as best shown in FIG. 10. In the preferred configuration, the roller holder 32, guide post 34 and brace member 92 are integral and made from metal or other sufficiently strong material and brace member 92, and therefore the combined roller holder 32 and guide post 34, is connected to the rear section 84 of top member 30 by one or more screws, bolts or other connectors 94 at or near the proximal end of brace member 92, as shown in FIGS. 5 and 10. In an alternative embodiment, brace member 92 can be fixedly attached to the bottom surface 42 of top member 30 at rear section 84 by welding, adhesives or other mechanisms appropriate for the materials utilized for the relevant components. In the embodiment of FIGS. 5 through 10, the roller holder 32 comprises a pair of spaced apart side members 96 and 98 that each comprise a slotted section 100 that is configured to receive and rotatably support the axle member 28 associated with roller 26, as best shown in FIGS. 5, 9 and 10. This embodiment shows the use of one or more stick, stick-like or wick type fragrance material 25 contained within the interior of the roller 26. Such fragrance material 25 should be selected so as to easily and efficiently dispense fragrance upon the rolling motion of roller 26 that results when the leading edge of paper 18 is pulled to remove paper 20 from roll of paper 14, which turns the roll of paper 14 and, by contact therewith, the roller 26 with the fragrance material 25 inside.

Figure 7:
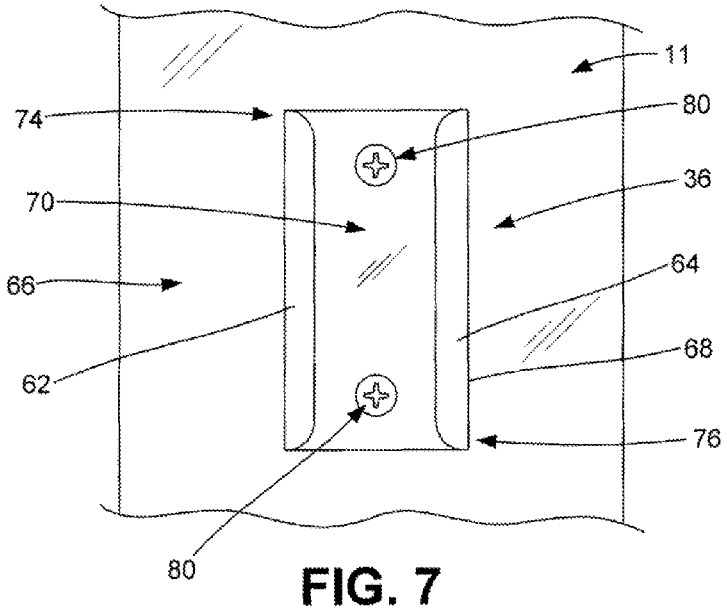
FIG. 7 is a front view of the base member of the cover apparatus of FIG. 5 shown attached to a surface with a pair of screws.
Figure 8:
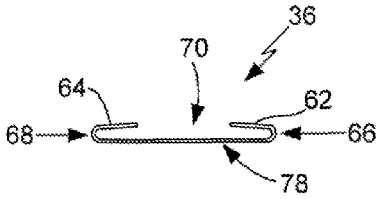
FIG. 8 is a top view of the base member of FIG. 7.
Figure 9:
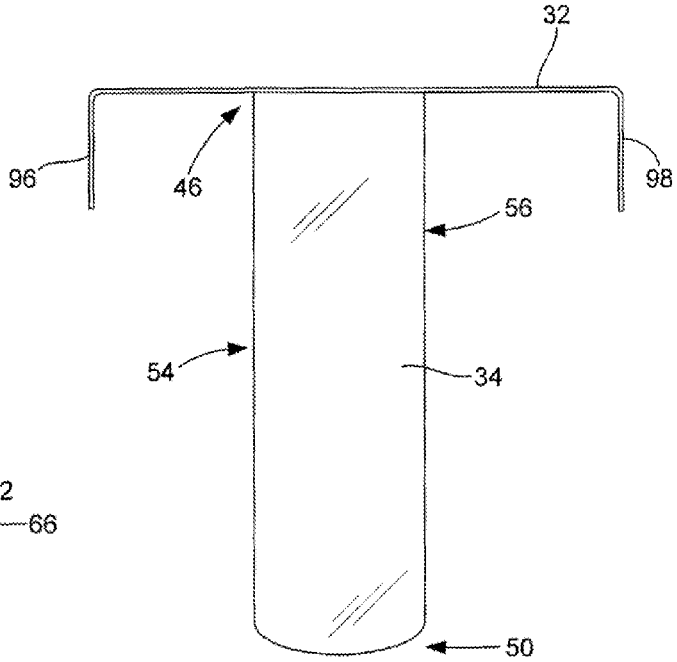
FIG. 9 is a front view of the roller holder and guide post of the cover apparatus of FIG. 5.

The preferred base member 36 for the embodiment of FIG. 5 is shown in FIGS. 7 and 8. As shown in these figures, the base member 36 is generally configured the same as the base member 36 shown in the embodiment of FIG. 1. In the present embodiment, however, the slots 72 are replaced by the spaces formed by the bent side sections 62 and 64 at the first 66 and second 68 sides, respectively, of the base member 36, as best shown in FIG. 8. The guide post 34 is slidably received in center section 70 between the first 62 and second 64 side sections of base member 36. As such, the first side 54 and the second side 56 of guide post 34 of this embodiment are generally straight or otherwise configured in corresponding relationship to the shape and size formed between the first 62 and second 64 side sections of base member 36. With the rear section 84 of top section 30 attached to the base member 36, by way of the brace member 92 having roller holder 32 at its distal end, the top member 30 and roller holder 32 will move up and down in cooperative relation with the up and down movement of guide post 34. As shown in FIGS. 5 and 10, and described above with the embodiment of FIG. 1, the roller 26 will rest on top of the rolled paper product 12, thereby holding the top member 30 above the roll of paper 14 and the guide post 34 in a raised position inside base member 36. As paper 20 is pulled from the roll of paper 14, causing the roll of paper 14 to get smaller, the guide post 34 will slide downward in base member 36, pulling the top member 30 downward to maintain the top member 30 in a fixed spaced apart relation with the rolled paper product 12. This configuration avoids the rolled paper product 12 being exposed below the top member 30 as the roll of paper 14 gets smaller during use of paper 20 therefrom, which would substantially defeat the purpose of having a cover for the rolled paper product 12.

Generally, the base member 30 can be attached to the surface 11 by use of the peel-off adhesive substance described above because the weight of the fragrance mechanism 22, top member 30 and guide post 34 will be supported by the rolled paper product 12 not the base member 36. In effect, base member 36 will only function as a guide for the guide post 34. In the embodiment of FIG. 5, the base member 36 is attached to surface 11 by use of screws as attachment mechanism 80, as shown in FIG. 7, through apertures provided in center section 70. If desired, one or more attachment mechanisms 80 can be utilized to secure the base member 36 to the surface 11. For instance, the screws can be used in addition to the peel-off adhesive substance to provide support for base member 36. Preferably, however, the peel-off adhesive is used alone. If the screws are utilized, the apertures for the screws should be recessed to allow the guide post 34 to freely move up and down in the center section 70. Alternatively, the back surface of the guide post 34 can be appropriately recessed to allow movement past any screws that hold base member 36 in position.

The preferred embodiment of the cover apparatus 10 of the present invention also includes one or more decorative items 102, such as the molding shown in FIGS. 5, 6 and 10, on the top surface 48 of the top member 30. The user can select the decorative item 102 to correspond to the type or style of the wall, cabinet or other surface 11 to which the cover apparatus 10 is attached. Alternatively, the decorative item 102 can be in contrast to the surface 11. In addition, the one or more decorative items 102 can be utilized to enhance the decor of the bathroom, kitchen or other area where the cover apparatus 10 is utilized. If desired, the decorative item 102 can be supplied with the cover apparatus 10 or a plurality of decorative items 102 can be supplied to allow the user to select that which best fits his or her area. The decorative item 102 can be interchangeable to allow the user to change the decor of his or her bathroom, kitchen or other room. Any decorative items 102 should be sized and configured to not interfere with the pivoting action of the front section 82 relative to the rear section 84, as shown in FIG. 10, so the top section 30 may freely move between its lowered 88 and raised 90 positions.

In one embodiment of the present invention, the cover apparatus 10 does not include any fragrance material 25. Instead, the roller 26 is configured to rotatably engage the rolled paper product 12 for the sole purpose of maintaining the top section 30 in the desired spaced apart relation and to not interfere with removing paper 20 from roll of paper 14. The diameter of roller 12 will provide the desired spacing between the rolled paper product 12 and top member 30. In addition, as will be readily appreciated by those skilled in the art, allowing the roller 26 to rotate will reduce the friction between roller 26 and the rolled paper product 12, thereby avoiding problems with obtaining paper 20 from the rolled paper product 12. In such an embodiment, it will not be necessary for the roller 26 to have a hollow chamber, as shown in FIGS. 1, 5, 6 and 10, that receives the fragrance material 25 inside roller 26. The roller 26 of this embodiment can be solid or substantially solid.

The preferred embodiment of FIGS. 5 through 10 is installed on surface 11 and utilized substantially the same as the embodiment described with regard to FIG. 1. The base member 36 is attached to surface 11 behind where the rolled paper product 12 is supported by product holder 5, typically centered between the two arms 6/7 thereof. If not already in position, rolled paper product 12 is placed on the product holder 5 in its normal manner. With base member 36 attached to surface 11, the guide post 34 is inserted at center section 70 between the first 62 and second 64 side sections to slidably engage side sections 62/64 and place the roller 26, which is rotatably supported by roller holder 32, in contact with the top surface of the rolled paper product 12 to rotatably engage the roller 26 with the roll of paper 14. The front section 82 of top member 30 is lowered to its lowered position 88 with the bottom surface 42 thereof placed against the upper surface of the roller holder 32 and the brace member 92, as shown in FIGS. 5 and 6. If desired, any decorative item 102, such as molding or the like, is placed onto the top surface 48 of top member 30, typically above the rear section 84 thereof, as shown in FIGS. 5 and 10. If desired and/or applicable to the cover apparatus 10, the user places one or more fragrance materials 25 inside the interior chamber of roller 26. When the user pulls a section of paper 20, typically by pulling at or near the leading edge 18, the roll of paper 14 will rotate, as it normally does, and cause the roller 26 to rotate. As the roll of paper 14 reduces in diameter, the guide post 34 will slide downward in base member 36, pulling the top member 32 and roller 26 down with it, thereby maintaining the desired spaced apart relation between the top section 32 and the roll of paper 14. The rotation of roller 26 will cause fragrance material 25 inside roller 26 to emit fragrance from the cover apparatus 10 to help mask and/or eliminate odors in the vicinity of cover apparatus 10 and rolled paper product 12. When the fragrance material 25 of fragrance mechanism 22 is empty or used up, the user raises the front section 82 to place the top member 30 in its raised position 90, as shown in FIG. 10, to remove the roller 26 from roller holder 32 and refill roller 26 with the fragrance material 25 of his or her choice. In an alternative embodiment, roller 26 and/or entire fragrance mechanism 22 can be configured to be replaceable with a new unit when the fragrance material 25 is empty or used up.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the method of the present invention is subject to modification with regard to any dimensional relationships set forth herein and modifications in assembly, materials, size, shape, and use. For instance, there are numerous components described herein that can be replaced with equivalent functioning components to accomplish the objectives of the present invention.

What is claimed is:

1. A cover apparatus for covering a rolled paper product having a roll of paper rotatably supported by a product holder attached to a surface, said cover apparatus comprising:

a base member attached to the surface;

a guide post having an upper end and a lower end, said guide post slidably engaged with said base member to move up and down relative to said base member;

a top member having a top surface, a bottom surface, a proximal end and a distal end, said proximal end of said top member attached to or integral with said guide post, said distal end of said top member extending outwardly from said guide post generally over the rolled paper product, said top member having a front area at said distal end thereof curved generally downward;

a roller holder attached to or integral with at least one of said top member and said guide post so as to move said guide post up and down with said roller holder; and a roller rotatably supported by said roller holder in rotatable engagement with the rolled paper product to rotate said roller when the roll of paper rotates and to maintain said top member and the roll of paper in fixed spaced apart relation, wherein said guide post and said top member move downward with said roller when paper is removed from the roll of paper so as to substantially maintain said top member and the roll of paper in fixed spaced apart relation when paper is removed from the roll of paper.

2. The apparatus of claim 1 further comprising a fragrance material associated with said roller so as to dispense fragrance when said roller rotates in response to rotation of the roll of paper.

3. The apparatus of claim 2, wherein said fragrance material is disposed inside said roller.

4. The apparatus of claim 1, wherein said top member comprises a front section toward said distal end of said top member and a rear section toward said proximal end of said top member, said front section pivotally attached to said rear section so as to allow said top section to move between a lowered position and a raised position.

5. The apparatus of claim 4, wherein said cover apparatus has one or more hinges interconnecting said front section and said rear section.

6. The apparatus of claim 4 further comprising a brace member interconnecting said roller holder and said guide post, said brace member attached to or integral with said rear section of said top member.

7. The apparatus of claim 1 further comprising a brace member interconnecting said roller holder and said guide post, said brace member attached to or integral with said top member.

8. The apparatus of claim 1, wherein said base member has a first side section and a second side section configured to respectively slidably engage a first side and a second side of said guide post.

9. The apparatus of claim 8, wherein said first side section and said second side section of said base member define a center section therebetween, said guide post slidably disposed in said center section.

10. The apparatus of claim 8, wherein each of said first side section and said second side section has a slot configured to slidably receive one or more pins on each of said first side and said second side of said guide post.

11. A cover apparatus for covering a rolled paper product having a roll of paper rotatably supported by a product holder attached to a surface, said cover apparatus comprising:

a base member attached to the surface, said base member having a first side section and a second side section defining a center section therebetween;

a guide post having an upper end, a lower end, a first side and a second side, said first side slidably engaged with said first side section of said base member and said second side slidably engaged with said second side section of said base member allow said guide post to move up and down relative to said base member in said center section thereof;

a top member having a top surface, a bottom surface, a proximal end and a distal end, said proximal end of said top member attached to or integral with said guide post, said distal end of said top member extending outwardly from said guide post generally over the rolled paper product, said top member having a front section toward said distal end of said top member and a rear section toward said proximal end of said top member, said front section pivotally attached to said rear section so as to allow said top section to move between a lowered position and a raised position;

a roller holder attached to or integral with at least one of said top member and said guide post so as to move said guide post up and down with said roller holder; and a roller rotatably supported by said roller holder in rotatable engagement with the rolled paper product to rotate said roller when the roll of paper rotates and to maintain said top member and the roll of paper in fixed spaced apart relation, wherein said guide post and said top member move downward with said roller when paper is removed from the roll of paper so as to substantially maintain said top member and the roll of paper in fixed spaced apart relation when paper is removed from the roll of paper.

12. The apparatus of claim 11 further comprising a fragrance material associated with said roller so as to dispense fragrance when said roller rotates in response to rotation of the roll of paper.

13. The apparatus of claim 12, wherein said fragrance material is disposed inside said roller.

14. The apparatus of claim 11 further comprising a brace member interconnecting said roller holder and said guide post, said brace member attached to or integral with said rear section of said top member.

15. The apparatus of claim 11, wherein each of said first side section and said second side section has a slot sized and configured to slidably engage one or more pins on each of said first side and said second side of said guide post.

16. The apparatus of claim 11, wherein said top member has a front area at said distal end thereof curved generally downward.

17. A cover apparatus for covering a rolled paper product having a roll of paper rotatably supported by a product holder attached to a surface, said cover apparatus comprising:

a base member attached to the surface;

a guide post having an upper end and a lower end, said guide post slidably engaged with said base member to move up and down relative to said base member;

a top member having a proximal end generally at said guide post and a distal end extending outwardly from said guide post generally over the rolled paper product, said top member having a front section toward said distal end of said top member and a rear section toward said proximal end of said top member, said front section hingedly attached to said rear section so as to allow said top section to move between a lowered position and a raised position;

a roller holder;

a brace member interconnecting said roller holder and said guide post so as to move said guide post up and down with said roller holder, said brace member attached to or integral with said rear section of said top member to move said top member with said roller holder; and a roller rotatably supported by said roller holder in rotatable engagement with the rolled paper product to rotate said roller when the roll of paper rotates and to maintain said top member and the roll of paper in fixed spaced apart relation, wherein said guide post and said top member move downward with said roller when paper is removed from the roll of paper so as to substantially maintain said top member and the roll of paper in fixed spaced apart relation when paper is removed from the roll of paper.

18. The apparatus of claim 17 further comprising a fragrance material associated with said roller so as to dispense fragrance when said roller rotates in response to rotation of the roll of paper.

19. The apparatus of claim 18, wherein said fragrance material is disposed inside said roller.

20. The apparatus of claim 17, wherein said top member has a front area at said distal end thereof curved generally downward.

* * * * *